United States Patent [19]

Dubach

[11] Patent Number: 4,854,473

[45] Date of Patent: Aug. 8, 1989

[54] SINGLE-PIECE SNAP HINGE CLOSURE

[75] Inventor: Werner F. Dubach, Maur, Switzerland

[73] Assignee: Alfatechnic AG, Switzerland

[21] Appl. No.: 189,787

[22] Filed: May 3, 1988

[30] Foreign Application Priority Data

May 13, 1987 [CH] Switzerland ..... 01834/87

[51] Int. Cl.[4] ..... B65D 43/24

[52] U.S. Cl. ..... 220/335; 220/339; 215/235

[58] Field of Search ..... 220/339, 335; 215/735

[56] References Cited

U.S. PATENT DOCUMENTS 3,933,271 1/1976 McGhie ..... 220/339
4,158,902 6/1979 Chernack et al. ..... 220/339
4,170,315 10/1979 Dubach ..... 220/339
4,414,705 11/1983 Ostrowsky ..... 220/339
4,545,495 10/1985 Kinsley ..... 220/339

*Primary Examiner*—Joseph Man-Fu Moy
*Attorney, Agent, or Firm*—Thomas W. Speckman; Douglas H. Pauley

[57] ABSTRACT

A snap hinge closure connects two parts, such as, for example, a lower and an upper part of a closure. Both parts have casing walls which, in the closed position of the hinge, match vertically above one another. On both sides of the film hinge, tension bands are positioned, which, in the closed position, are tensed. The tension bands are held, with their ends, in recesses (11) in the casing walls, and have, over their entire length, an approximately uniform cross section. The outermost surfaces of the tension bands align with the casing external surfaces.

7 Claims, 2 Drawing Sheets

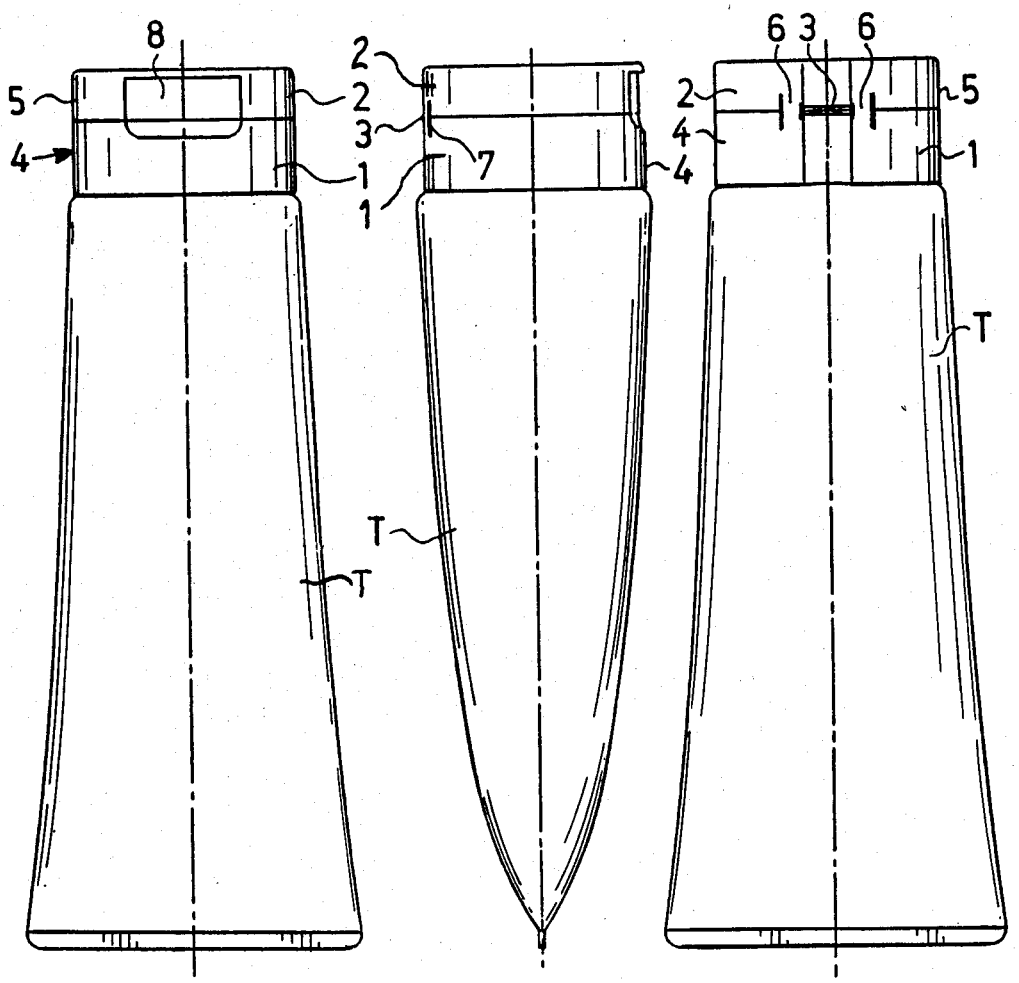
FIG. 1 FIG. 2 FIG. 3
FIG. 4
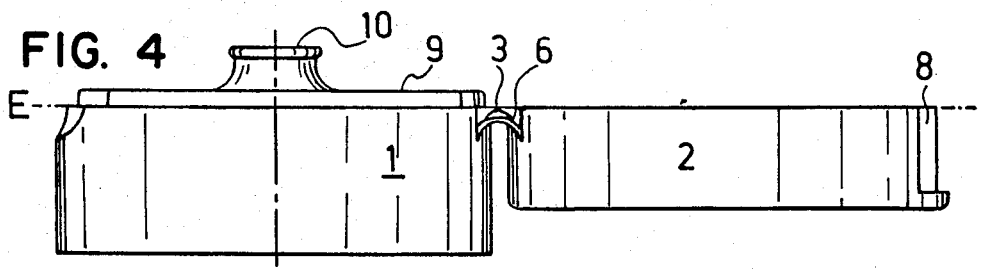

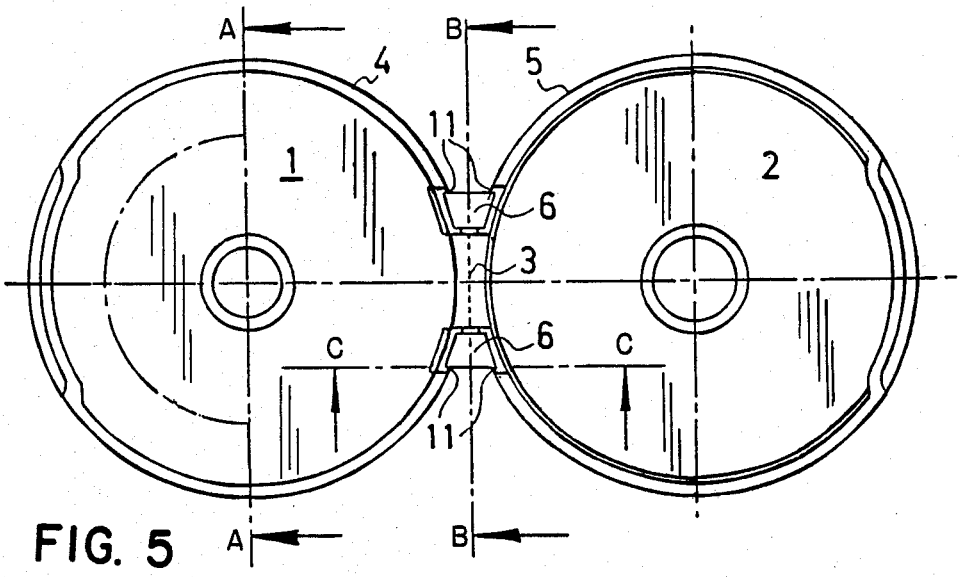
FIG. 5
FIG. 6
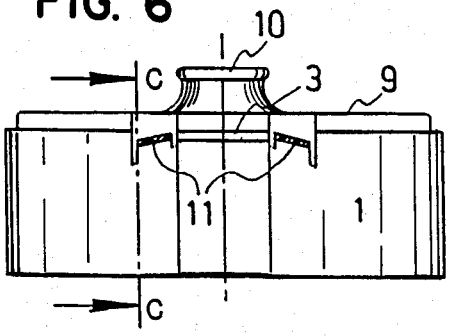
FIG. 7
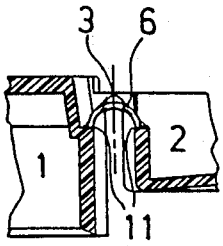
FIG. 8a
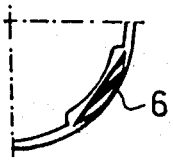
FIG. 8b
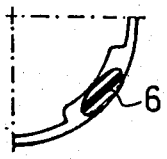
FIG. 8c
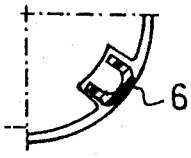
FIG. 8d
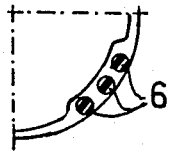

SINGLE-PIECE SNAP HINGE CLOSURE

BACKGROUND OF THE INVENTION

1. Field of the Invention

The present invention concerns a single-piece snap hinge closure of plastic with a lower part and a cap, whereby each part has a casing wall. In the closed condition of the closure, these casing walls stand vertically above one another at equal elevation. The lower part is connected with the cap by means of at least one film hinge as well as by means of two tension bands positioned on each side of the film hinge, which bands, in the closed condition of the closure, are extended.

2. Description of the Prior Art

A snap hinge closure of the general type already stated is known, for example, from European Pat. No. 0 147 423. The tension bands according to the prior art patent are generally connected to attachments, which are placed on the external casing surface and lie in a plane which intersects the plastic closure in the manner of a secant. These closures have proven to be most superior, considered from the viewpoint of the manner of their operation, strength and closing force. What has been found defective in the marketplace, however, has been, above all else, their aesthetic appearance, as well as the possibility of working with the closures in bottling stations. The protruding tension bands provided a genuine cause for obstructions on conveyor belts.

One solution to the second problem stated is represented in European Pat. No. 056 469. In this case, instead of tension bands, work is carried out with intermediate elements positioned laterally to the film hinge joint, which are thick-walled and are connected with the lower part or the cap by means of film hinges. The force necessary for the snapping effect to take place is not formed here by the longitudinal expansion of the intermediate elements, but rather through the re-forming force of the intermediate elements which are arch-shaped. The tension forces arising during the opening and closing of the closure run through the film hinges, by which the intermediate elements are connected with the cap or the lower part. The film hinge forming the swivel axis is compressed upon opening the closure. While the compression of a film hinge is non-problematic, tension forces represent a great danger to the film hinge. If the tension forces proceed precisely in the direction perpendicular to the axis of the film hinge, then the resistance force is still relatively great. In one oblique position of the film hinge, as European Pat. No. 056 469 claims, however, the stated correct force effect is not ensured. The result is that, on the sides of the film hinges, an excess expansion appears with the notch effect, and the film hinges tear.

SUMMARY OF THE INVENTION

The material thickness in the area of the film hinge amounts to only 0.1 to 0.2 mm. This leads, because of the forming process, to a directional orientation of the macromolecules in the film hinge area. In areas in which the macromolecules are directionally oriented, these forces, which are slight, blend laterally to the direction of progress, as appears in the execution in accordance with the above-stated invention. In this regard, the materials thickness in a tension band of approximately 0.5 to 0.8 mm is 4 to 5 times greater. A directional orientation of the macromolecules during the forming process does not take place here. The direction of the effect of the force on the tension bands is thus non-essential. Furthermore, the size of the openings in the injection form, through which the material always flows from the lower part into the cap, determines the time cycle of the forming process.

The applicant gained the above knowledge through extensive measurements and experiments, and thus set about the task of creating a plastic hinge of the type stated above, in which problems of the type stated can be avoided.

The present invention solves the above problem by having tension bands positioned in recesses in the casing walls, the tension bands having over their entire length at least approximately uniform cross section and in the closed position their outermost surfaces align with the external surfaces of the casing walls. Means for attachment of the tension bands may be integrally formed and rounded into the base surfaces of the recesses in the casing walls. In one embodiment, a strip-shaped tension band is positioned on each side of a film hinge, each tension band being placed on an inclination on the recessed base surfaces so that the sides of the strip-shaped tension band nearer to the film hinge are shorter than the sides at a greater distance from the film hinge. In such embodiment, the cross-sectional form of the tension bands approximate a quadrilateral, while in other embodiments the cross-sectional form of the tension bands may be convex on at least one side, U-shaped, or the tension bands may be sub-divided into several partial tension bands.

BRIEF DESCRIPTION OF THE DRAWING

One example of execution of the object of the invention is described by means of the following specific description and is depicted in the drawing, wherein:

FIG. 1: a snap hinge closure in approximately natural size on a tube in a view from the front;

FIG. 2: is a side view of the hinge closure shown in FIG. 1;

FIG. 3: is a rear view of the hinge closure shown in FIG. 1;

FIG. 4. is an enlarged side view of the hinge closure shown in FIGS. 1–3 in the completely opened position;

FIG. 6: is a section through the pivoting axis of the hinge along the line B—B in FIG. 5;

FIG. 7: is a partial section along the line C—C in FIG. 5; and

FIGS. 8*a–d:* are cross-sectional views of different tension bands.

DESCRIPTION OF PREFERRED EMBODIMENTS

Figure 5:
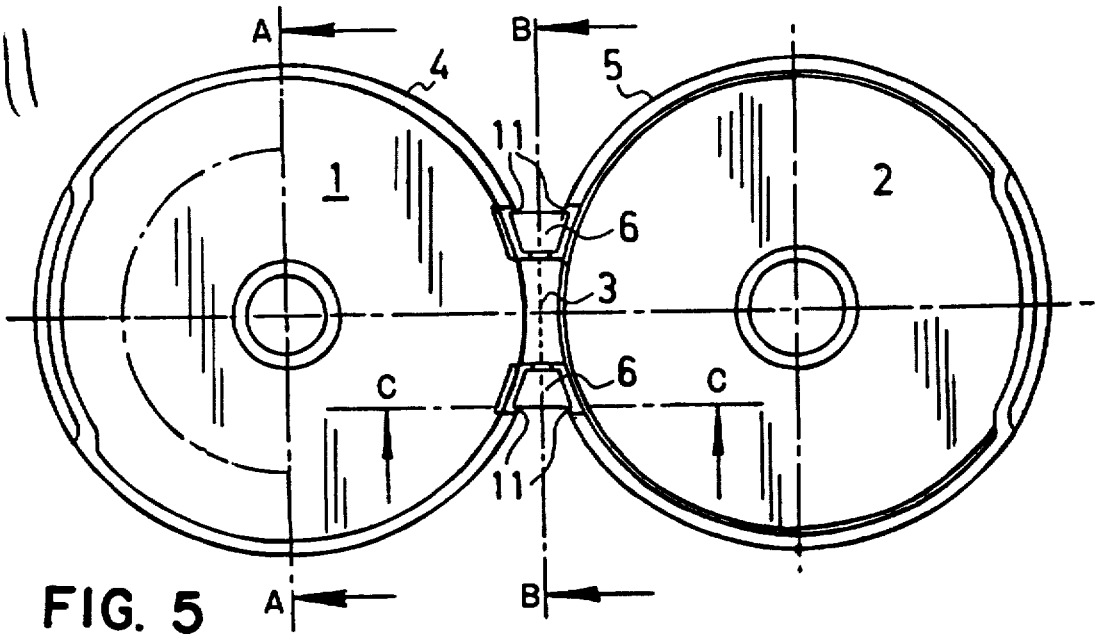
FIG. 5: is a top view of the hinge closure shown in FIG. 4 whereby the cap is seen from the interior.

In the drawing, the lower part of the one-piece snap hinge closure is designated by (1), and the upper part connected with it is designated by (2). The snap hinge is integrated into a closure in the form depicted. It is evident, however, that the snap hinge n accordance with the invention can also be integrated into any type of packaging, particularly, such as boxes and cases of plastic which are formed in a single piece. The example of execution in accordance with the invention shown is a closure in which the lower part (1) of the closure is attached to a tube (T). The upper part (2) is in this case a cap. Both the parts (1 and 2) of the closure are connected with one another by means of a regular film hinge (3) projecting a short distance along the circumferential casing wall. The casing wall (4) of the lower part (1) and the casing wall (5) of the cap, or the upper part (2), match vertically above one another. An indentation (8), which should serve to facilitate the opening of the closure, is provided in the upper and lower parts lying opposite the film hinge. To the left and the right of the film hinge (3), both the tension bands (6) are recognizable almost only at their ends. They are so integrated in the casing surfaces (4 and 5) that only the lateral boundaries (7) are still discernible. The external surfaces of the tension bands (6) align, apart from slight divergences, with the casing surfaces of the upper and lower part (1, 2).

In FIG. 4, the same example of execution of the snap hinge on the closure in accordance with FIGS. 1–3 is shown, in a larger scale, in the completely open position. Lower part (1) has a top surface (9) which rises over the junction plane (E) of the upper and lower parts (1, 2), and has an outlet (10) extending conically upwards. Tension bands (6) are not tensed in this position and form an arc. Since the tension bands here lie on the periphery of the curved casing surfaces, the tension bands, in the area closer to the film hinge, are curved more sharply than the areas further removed from the film hinge. Thus the tension band is seen as a double arch in the lateral view. Also, in the view in accordance with FIG. 5, which shows a view from above the closure in accordance with FIG. 4, it can be seen that the radius of the tension bands (6) which are arch-formed in this position of the hinge, are smaller nearer to the film hinge (3) and larger farther from the film hinge (3). In the detail shown in FIG. 7, this is seen in a section along the line C—C in FIG. 5.

In the depiction in accordance with FIG. 5, in which the upper part or the cap can be seen from below or from the inside, and the lower part is seen from above, the recesses (11) in which the tension bands are fastened can be seen as well. The recesses in the cap or the upper part (2) do not penetrate the casing wall (5), but rather allow a minimum necessary wall thickness to exist, so that, in the closed condition of the closure, the upper part and the lower part rest on one another over the entire circumference of the casing walls. This is of considerable importance, since plastic parts of the known type charge strongly with static electricity. As a result, in a closure which is not completely closed, dust particles are magnetically drawn into the interior through possibly existing slots, which leads to visible contamination. The base surfaces of the recesses (11) can extend in parallel or in inclination to the junction plane (E). In this case, of course, the tension bands (6) must each be longer, the further they are from the pivot axis, namely film hinge (3). Consequently, the bases of the recesses extend inclined from the end at a distance from the film hinge, from below to the upper end which is closer to that of the film hinge. In FIG. 6, in a vertical cross section through the open closure through the film hinge, the bases of the recesses are depicted in dotted form, although they are normally not visible in this view.

One essential difference between the tension bands, as they are used in this invention, and the intermediate elements in accordance with the state of the art, is that the tension bands (6), from the contact point in the recesses (11) and over their entire length, have at least approximately the same cross-sectional surface. of course, the bands can be rounded and thickened at their ends, in order to prevent a notch effect. In the area, however, which leads to the necessary spring stretching quantity, the cross-sectional surface remains equal, apart from imprecisions.

The cross-sectional form of the tension bands (6) can be formed very differently. The examples of FIGS. 8-*a* to 8-*d* demonstrate this. Thus, the external surface can be precisely adjusted to the contour of the casing wall, but the internal surface can be straight (FIG. 8-*a*).

However, in addition to the purely rectangular form, as shown in FIG. 6, a form which is convex on all sides, for example, an ellipse as in FIG. 8-*b*, would also be possible. If the bands are formed in a U-shape as shown in FIG. 8-*c*, then there is obtained a reinforced snap effect of the hinge. The subdivision of the tension bands into several partial bands, as FIG. 8-*d* shows, permits a still better adjustment of the snap hinge in accordance with the invention to the relatively complexly formed shapes of both parts which are connected with one another by means of the hinge. If the snap hinge in accordance with the invention is realized in a box or case with four or more sides, then several film hinges, all of which lie in a straight line, can be provided on the straight side. Then the hinge in accordance with the invention can appear repeatedly.

I claim:

1. In a single-piece snap hinge closure having vertical casing walls with a generally rounded periphery of plastic comprising a lower part (1) and an upper part (2), each of which has one of said casing walls (4, 5), whereby both said casing walls (4, 5), in a closed condition of the hinge closure, matching vertically above one another, and whereby said lower part (1) is connected with said upper part (2) by means of at least one film hinge (3), and by means of two tension bands (6) positioned on each side of said at least one film hinge (3), in said closed condition of the hinge closure, said tension bands (6) are tensioned and are positioned in recesses (11) in said casing walls, the improvement comprising: said tension bands (6) being elastically stretchable and distally positioned on both sides of said at least one film hinge (3), and said tension bands (6) having a trapezoidal cross-sectional shape of approximately uniform thickness over an entire length of each said tension band (6).

2. A snap hinge closure in accordance with claim 1, wherein means for attachment of said tension bands (6) are integrally formed and rounded into base surfaces of said recesses (11) in said casing walls (4, 5).

3. A snap hinge closure in accordance with claim 1, wherein attachment of said tension bands (6) extend level and parallel to the pivot axis of said film hinge (3) in base surfaces of recesses (11) in said casing walls (4, 5).

4. A snap hinge closure in accordance with claim 1 wherein said vertical casing walls (4, 5) are rounded and that only one film hinge (3) is provided, on each side of which a strip-shaped tension band (6) is positioned whereby each said tension band (6) is positioned at an inclination on recess (11) base surface inclined to the pivot axis of said film hinge (3) so that the sides of each said strip-shaped tension band (6) lying nearer to said film hinge (3) is shorter than at the side at a greater distance from said film hinge (3) relative to an outer side of each said tension band, is shorter than said outer side.

5. A snap hinge closure in accordance with claim 1, wherein said recesses (11) at least approximately correspond to a form and a size of the tensioned said tension bands (6) so that said tension bands (6), in the closed position of said film hinge (3), are completely accommodated in said recesses (11) and cover said recesses (11).

6. A snap hinge closure in accordance with claim 1, wherein the trapezoidal cross-sectional shape of each said tension band (6) is convex on at least one side.

7. A snap hinge closure in accordance with claim 1, wherein each of said trapezoidally-shaped tension bands (6) is subdivided into several parallel partial bands (6).

* * * * *

UNITED STATES PATENT AND TRADEMARK OFFICE

CERTIFICATE OF CORRECTION

PATENT NO. : B1 4,854,473

DATED : October 15, 1991

INVENTOR(S) : Werner F. Dubach

It is certified that error appears in the above-indentified patent and that said Letters Patent is hereby corrected as shown below:

Column 1, line 42, delete the comma after "closure".
Column 2, line 5, delete "band" and in its place insert --bands--.
Column 2, line 39, insert a comma after "hinge (3)".

Signed and Sealed this

Fourteenth Day of December, 1993

*Attest:*

Bruce Lehman

BRUCE LEHMAN

*Attesting Officer*

*Commissioner of Patents and Trademarks*

REEXAMINATION CERTIFICATE (1576th)

United States Patent [19] [11] B1 4,854,473

Dubach [45] Certificate Issued Oct. 15, 1991

[54] SINGLE-PIECE SNAP HINGE CLOSURE

[75] Inventor: Werner F. Dubach, Maur, Switzerland

[73] Assignee: Alfatechnic AG, Dietlikon, Switzerland

Reexamination Request:
No. 90/002,114, Aug. 17, 1990

Reexamination Certificate for:

| | |
|---|---|
| Patent No.: | **4,854,473** |
| Issued: | **Aug. 8, 1989** |
| Appl. No.: | **189,787** |
| Filed: | **May 3, 1988** |

[30] Foreign Application Priority Data

May 13, 1987 [CH] Switzerland ..... 1834/87

[51] Int. Cl.[5] ..... B65D 43/24

[52] U.S. Cl. ..... 220/335; 220/339; 215/235

[58] Field of Search ..... 220/335, 339; 215/235

[56] References Cited

U.S. PATENT DOCUMENTS 4,403,712 9/1983 Wiesinger .
4,573,600 3/1986 Dubach .

FOREIGN PATENT DOCUMENTS 0056469 12/1981 European Pat. Off. .
0147423 5/1984 European Pat. Off. .

*Primary Examiner*—Joseph Man-Fu Moy

[57] ABSTRACT

A snap hinge closure connects two parts, such as, for example, a lower and an upper part of a closure. Both parts have casing walls which, in the closed position of the hinge, match vertically above one another. On both sides of the film hinge, tension bands are positioned, which, in the closed position, are tensed. The tension bands are held, with their ends, in recesses (11) in the casing walls, and have, over their entire length, an approximately uniform cross section. The outermost surfaces of the tension bands align with the casing external surfaces.

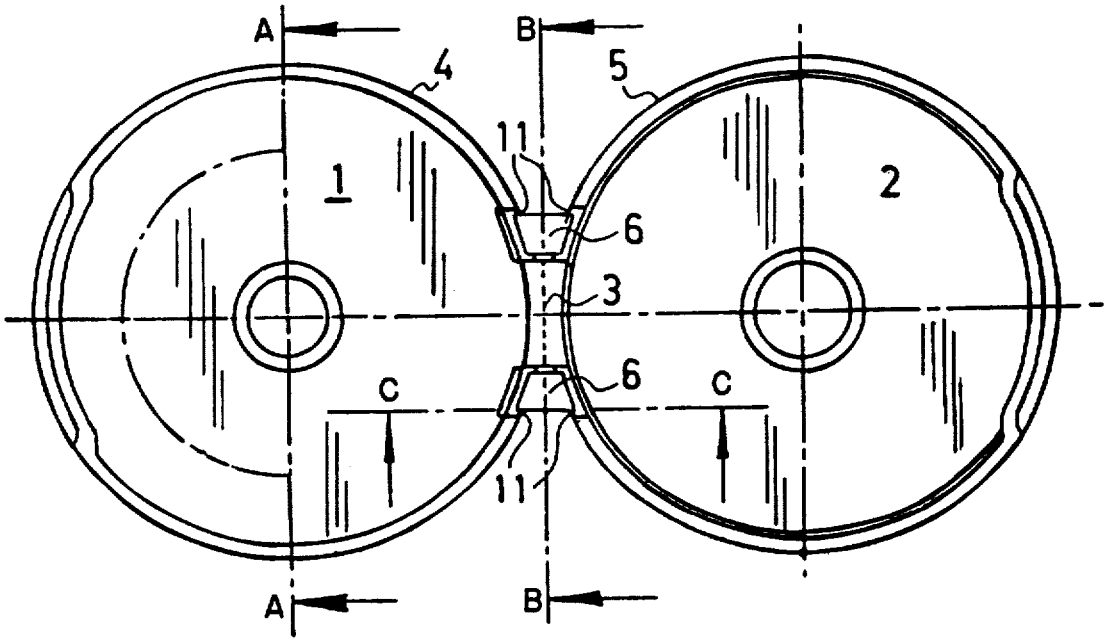

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2, 3 and 4 are cancelled.

Claims 1, 5, 6 and 7 are determined to be patentable as amended.

New claim 8 is added and determined to be patentable.

1. [In a] *A plastic* single-piece snap hinge closure [having] *comprising: two* vertical casing walls [with a generally rounded periphery of plastic comprising] *forming* a *peripherally rounded* lower part (1) and [an] *a peripherally rounded* upper part (2), [each of which has one of said casing walls (4, 5), whereby both said casing walls (4, 5),] in a closed condition of the hinge closure[, matching] *both said casing walls (4, 5)* vertically *aligned* above one another[, and whereby] *and forming a junction plane (E) between said lower part (1)* and said upper part (*2*), said lower part (1) [is] connected with said upper part (2) by [means of at least one] *a* film hinge (3)[,] and by [means of] two tension bands (6) *each* positioned on [each side] *opposite sides* of *and at a distance from* said [at least one] film hinge (3), *in an open condition of the hinge closure said film hinge coplanar with said junction plane (E)*, in said closed condition of the hinge closure, said tension bands (6) [are] tensioned and [are]positioned in *two corresponding* recesses (11) in said casing walls (*4*, *5*), [the improvement comprising:] *two opposing ends of each said tension band (6) respectively molded into said casing walls (4, 5) so that said tension band (6) merge integrally into said casing walls (4, 5)*, in said closed condition said opposing ends being positioned on opposite sides of said junction plane (*E*), said tension bands (6) being elastically stretchable, [and distally positioned on both sides of said at least one film hinge (3), and] said tension bands (6) having [a trapezoidal cross-sectional shape of] approximately uniform thickness over an entire length of each said tension band (6), *and in said closed condition each said tension band (6) having a trapezoidal shape between said integrally formed opposing ends of each said tension band (6)*.

5. A snap hinge closure in accordance with claim 1, wherein said recesses (11) at least approximately correspond to a form and a size of [the tensioned] said tension bands (6) *in a tensioned state* so that said tension bands (6), in [the ] *said* closed [position] *condition* of [said film]*the* hinge [(3)] *closure*, are completely [accommodated in] *positioned within* said recesses (11) and cover said recesses (11).

6. A snap hinge closure in accordance with claim 1, wherein [the] *said* trapezoidal [cross-sectional] shape of each said tension band (6) is convex on at least one side.

7. A snap hinge closure in accordance with claim 1, wherein each [of] said trapezoidally-shaped tension [bands] *band* (6) is subdivided into several parallel partial *tension* bands (6).

*8. A snap hinge closure in accordance with claim 1 wherein each said tension band (6) is positioned at an inclination on said recesses (11) base surface inclined to the pivot axis of said film hinge (3) so that an inner side of each said trapezoidally-shaped tension band (6) positioned closer to said film hinge (3) relative to an outer side of each said tension band (6), is shorter than said outer side.*

* * * * *